US005341962A

United States Patent [19]

Way et al.

[11] Patent Number: 5,341,962

[45] Date of Patent: Aug. 30, 1994

[54] SWING ARM FEEDER

[75] Inventors: Peter F. Way, Topsfield, Mass.; William L. Petitjean, Fall City, Wash.

[73] Assignee: Cadence Environmental Energy, Inc., Michigan City, Ind.

[21] Appl. No.: 18,894

[22] Filed: Feb. 17, 1993

[51] Int. Cl.[5] ..... G01F 11/24

[52] U.S. Cl. ..... 222/248; 110/109; 222/409; 414/198; 414/525.5

[58] Field of Search ..... 222/243-248, 222/372, 409; 414/198, 172, 293, 525.5, 525.3, 525.2, 525.1; 100/142, 215; 110/109, 289, 108, 290

[56] References Cited

U.S. PATENT DOCUMENTS

| | | | |
|---|---|---|---|
| 896,759 | 8/1908 | Robinson | 222/248 |
| 1,040,991 | 10/1912 | Avram | 222/409 X |
| 1,472,280 | 10/1923 | Ousdahl | 222/409 |
| 1,503,791 | 8/1924 | Hutchins | 414/214 |
| 1,570,604 | 1/1926 | Aram | 222/409 X |
| 1,723,880 | 8/1929 | Paltzer | 198/739 |
| 2,037,990 | 4/1936 | Martin | 110/109 X |
| 2,539,780 | 1/1951 | Hall | 222/243 |
| 2,625,937 | 1/1953 | Sperry | 222/409 X |
| 2,637,468 | 1/1953 | Wekerle | 222/409 X |
| 3,559,823 | 2/1971 | Ostrin | 414/198 X |
| 3,855,950 | 12/1974 | Hughes, Jr. et al. | 110/109 X |
| 3,968,906 | 7/1976 | Kochendorfer et al. | 222/243 |
| 4,036,124 | 7/1977 | Seiler et al. | 110/109 X |
| 4,571,137 | 2/1986 | Malmgren | 110/289 X |
| 5,151,000 | 9/1992 | Geraghty et al. | 414/198 X |

*Primary Examiner*—Kevin P. Shaver
*Attorney, Agent, or Firm*—Barnes & Thornburg

[57] ABSTRACT

A feeder for discharging a load of material includes a hopper, a swing arm pivoting between raised and lowered positions in the hopper, and a ram mounted on the free end of the swing arm. The ram is moved by the swing arm back and forth on a curved floor in a trapezoidally shaped trough underneath the hopper to push material in the trough out of the hopper through a discharge outlet. A shutoff valve at the discharge outlet prevents backflow of discharged material into the trough.

26 Claims, 2 Drawing Sheets

SWING ARM FEEDER

BACKGROUND AND SUMMARY OF THE INVENTION

This invention relates to a feeder for dispensing various types of materials from a hopper to a place outside the hopper, and particularly to a swing arm feeder. More particularly, this invention relates to a feeder including a swinging ram that is movable in a trough located at the bottom of the hopper to discharge solid waste materials and sludges from the hopper through a discharge outlet.

Sludges and shredded solids are industrial waste materials that are difficult to transport and handle. In many industrial processes, waste sludges and solids are first accumulated in large hoppers and then discharged into smaller containers for delivery to a point of use. For example, disposal of many solid waste materials is accomplished by collecting such materials in a hopper and discharging small batches of such materials into waste incinerators or cement kilns. Advantageously, burning waste in the firing chamber of a cement kiln is economical because the waste material is disposed in an environmentally sound manner and serves as fuel to sustain the burn in the kiln firing chamber.

Delivery of sludges and shredded solids to an incinerator, kiln, or other destination presents a number of significant engineering challenges. Solid wastes can occur in many forms ranging from hard crystalline solids to viscous sticky sludges. They are not easily blended or dispensed.

Conventional feeder mechanisms have not handled sludges and shredded solids particularly well. Conventional screw feeders are limited by an inability to handle stringy materials or materials that tend to cake or build up on the auger provided in the screw feeder to move waste materials. Conventional reciprocating ram feeders often jam in use as a result of waste material build-up behind the ram.

Moreover, waste material "bridging" problems often develop in the hoppers of conventional screw or reciprocating ram feeders because of the tendency of both wet, sticky waste sludges and dry waste solids periodically to form a somewhat horseshoe-shaped arch over the movable auger or ram. This waste material arch is sometimes called a "bridge." Whenever a waste material bridge develops in a hopper above a movable auger, ram, or the like, it acts as a barrier to block other waste material in the hopper from reaching the underlying movable auger, ram, or other discharge mechanism. Unfortunately, conventional feeders can be disabled or impaired by waste material bridging problems.

Recognizing the importance of disposing waste materials in a proper and effective manner, there is a need for a hopper and feed mechanism for waste sludges and solids. Such a mechanism would operate in a manner so as to overcome waste material bridging problems automatically and to mix the waste materials in the hopper continuously. It would further operate to dispense a series of small batches of waste material out of the hopper to a destination such as a container-filling system or the like. A feeder that could meet such demands would represent a substantial improvement over conventional feeders.

According to the present invention, a feeder is provided for discharging a load of material to a place outside the feeder. The feeder includes a hopper, a discharge outlet, and an inclined trough located in a bottom portion of the interior region of the hopper. Various types of materials can be stored in the hopper for later discharge via the inclined trough and the discharge outlet. The inclined trough is formed to include a curved material-receiving channel having a curved floor.

The feeder further includes a ram movable in the curved material-receiving channel and on the curved floor. The ram is movable along this curved path between a raised position away from the discharge outlet and a lowered position adjacent to the discharge outlet. The feeder also includes means for moving the ram on the curved floor from its raised position to its lowered position to discharge a load of material out of the hopper through the discharge outlet to a place outside the feeder.

In preferred embodiments, the moving means includes a pivotable swing arm having a lower end appended to the ram and an upper end mounted on a pivot shaft extending along a front edge of the hopper. Advantageously, the pivoting movement of the swing arm needed to move the ram back and forth between its raised and lowered positions causes the swing arm to slice through the material stored in the hopper. This cyclic slicing movement of the swing arm provides the agitation needed to break up any waste material bridges that may develop and thereby overcome material bridging problems. Also, mixing blades are mountable on the swing arm to facilitate blending of the material in the hopper during pivoting of the swing arm back and forth in the hopper.

Preferably, the inclined trough has a trapezoidal shape and includes first and second inclined side walls. These side walls extend along the curved floor of the material-receiving channel in spaced-apart relation to one another. The side walls are inclined to converge toward the floor to define the trapezoidal shape of the inclined trough. Ideally, the ram includes a body having a matching trapezoidal cross-sectional shape and a curved bottom surface engaging the curved floor of the material-receiving channel. The trapezoidal design of the inclined trough and the ram advantageously enhances the material-discharging capacity of the feeder. This feeder is able to handle discharge of many stringy, sticky, shredded solid waste materials and sludges without frequent jamming.

Illustratively, a valve is provided at the discharge outlet to regulate discharge of material from the hopper. The valve is configured to prevent backflow of material that has been discharged from the material-receiving channel through the discharge outlet back into the material-receiving channel during movement of the ram in the channel from its lowered position to its raised position. Advantageously, the valve does not block or otherwise disrupt discharge of material from the hopper through the discharge outlet.

Although various hopper shapes may be used to enclose the swing arm and provide the required waste material holding capacity, it ideally includes a pair of conical side wall sections arranged to lie in spaced-apart cup-shaped relation on either side of the inclined trough to funnel material in the interior region of the hopper into the trapezoidal, curved material-receiving channel through a top opening in the trough. Illustratively, each conical side wall section is a quarter section of a very short and broad-based cone. This type of hopper shape also helps to control movement of material in the interior region of the hopper toward the trough and prevent material arches or bridges over the trough from forming.

Additional features and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

An improved feeder 10 is provided for delivering a series of batches of material to a destination. Illustratively, feeder 10 is a swing arm feeder of the type shown in FIG. 1. This feeder 10 is well suited for use in dispensing sludges and shredded solids to a container filling system (not shown) or other destination.

Figure 1:
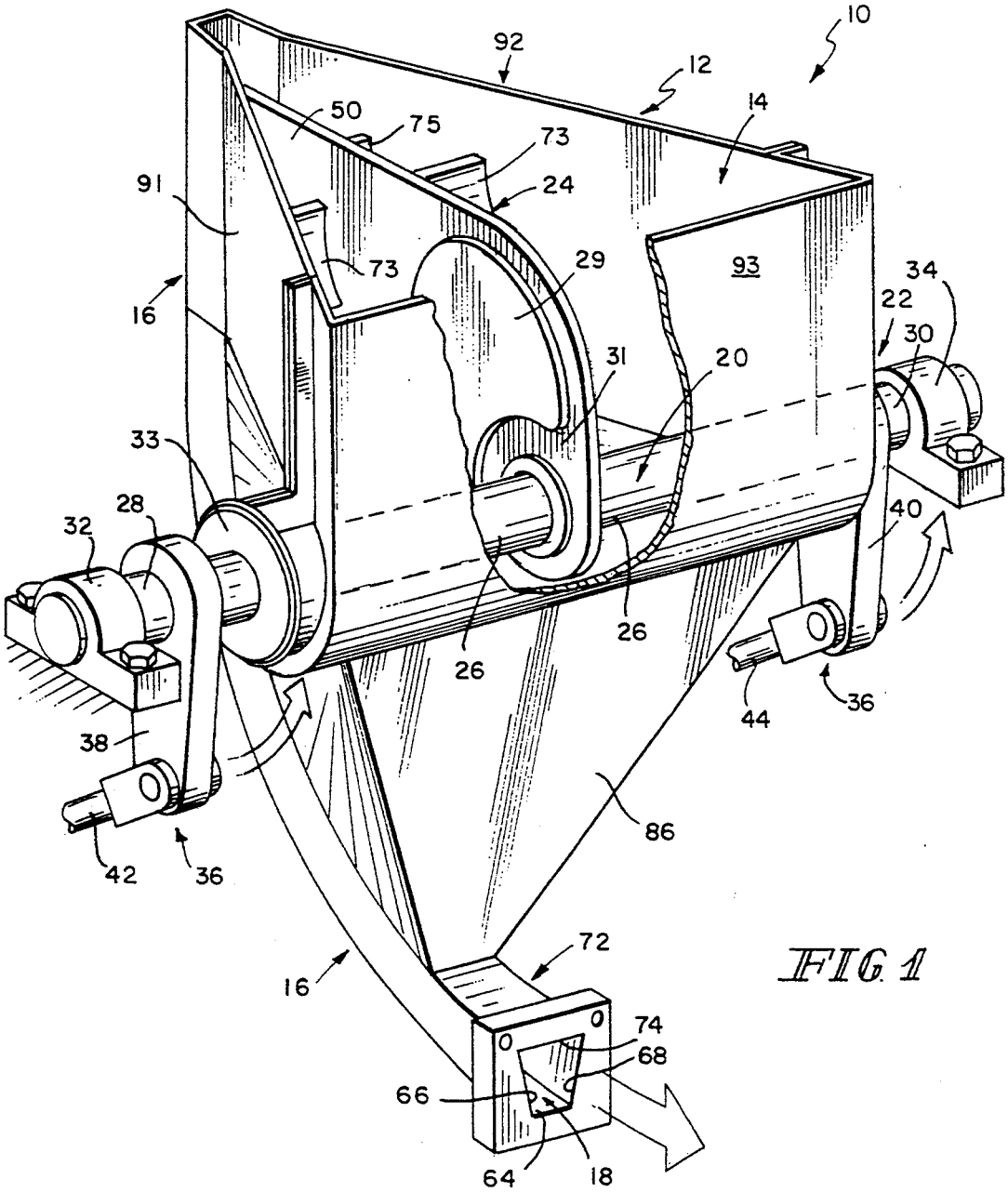
FIG. 1 is a perspective view of a feeder in accordance with the present invention, with portions broken away, showing a hopper, a curved trough underlying the hopper, a trapezoidally shaped discharge channel in the trough, and a swing arm pivotably mounted on a rotatable pivot shaft.

Feeder 10 includes a hopper 12 having an interior region 14, a curved trough 16 located underneath the hopper 12, a discharge outlet 18 at the front end of the trough 16, and a pivot shaft 20 extending along a front edge 22 of the hopper 12 as shown in FIG. 1. A swing arm 24 is located in the interior region 14 of the hopper 12 and mounted for pivotable movement in the hopper 12 between a raised position shown in FIGS. 1 and 2 and a lowered position shown in FIG. 3.

Figure 2:
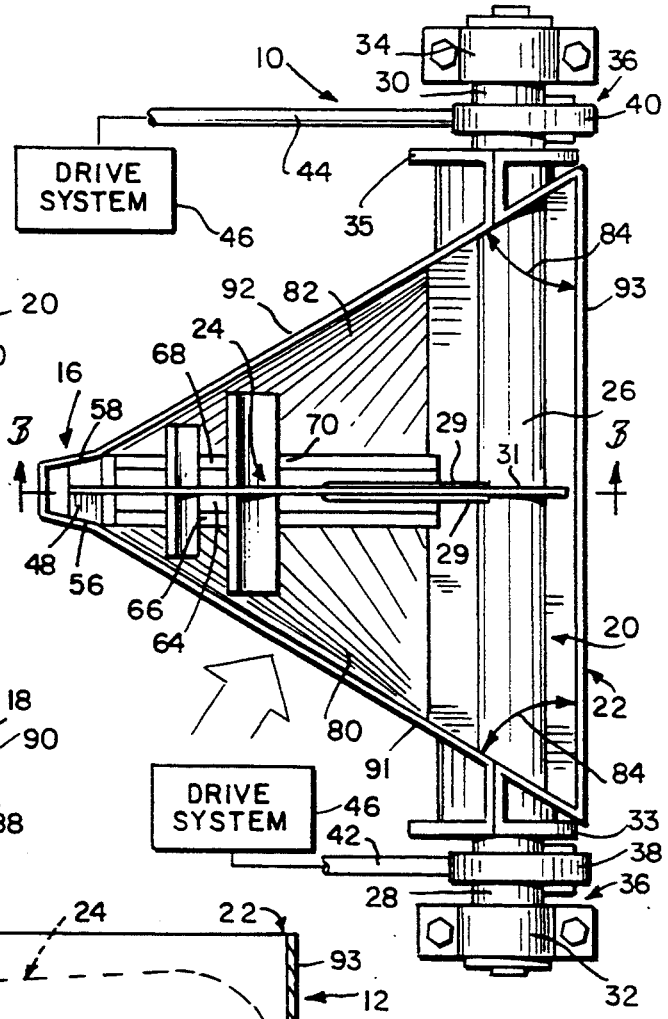
FIG. 2 is a top plan view of the feeder of FIG. 1 showing a trapezoidally shaped ram in its raised position in the trapezoidally shaped trough and the first and second conical side walls on opposite sides of the trough.

The pivot shaft 20 includes a central portion 26 passing through the interior region 14 of the hopper 12 and journals 28, 30 lying on either side of the hopper 12. The swing arm 24 includes an upper end 31 attached to the central portion 26 of the pivot shaft 28 as shown best in FIG. 1. The left journal 28 of pivot shaft 20 turns in hopper bearing 32 and outside bearing 33 and the right journal 30 of pivot shaft 20 turns in hopper bearing 34 and outside bearing 35 as shown in FIGS. 1 and 2. Illustratively, swing arm 24 is formed to include one or more reinforcement welts like welt 29 to strengthen the swing arm 24.

Figure 3:
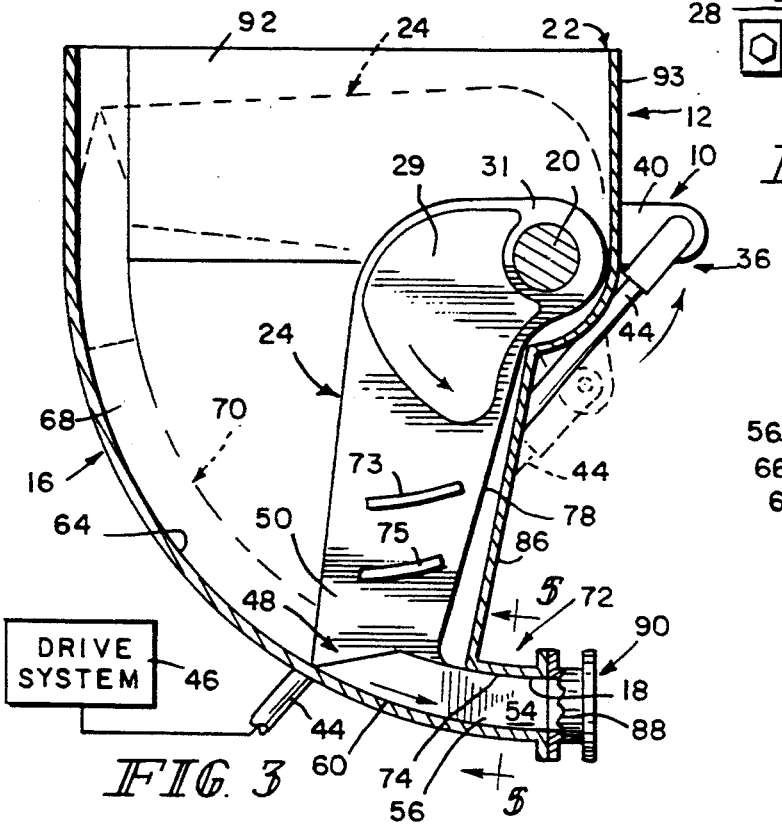
FIG. 3 is a sectional view taken generally along line 3—3 of FIG. 2 but showing the ram in its lowered position adjacent to the discharge outlet and engaging the curved bottom surface of the channel in the trough.

The pivot shaft 20 is turned about its longitudinal axis in bearings 32–35 by a drive mechanism 36 to pivot the swing arm 24 back and forth in the interior region 14 of hopper 12 between a raised position (shown in dotted lines in FIG. 3) and a lowered position (shown in solid lines in FIG. 3). Illustratively, drive mechanism 36 includes first and second yokes 38, 40, first and second crank arms 42, 44, and drive system 46 for moving the crank arms 42, 44 back and forth to turn the pivot shaft 20 about its longitudinal axis first in a clockwise direction and then in a counterclockwise direction. For example, drive system 46 could include a pair of hydraulic cylinders (not shown) for moving crank arms 42, 44. An alternative drive mechanism (not shown) could be based on use of a single hydraulic cylinder centered above the hopper to operate directly on the swing arm, thus eliminating the crank arms.

Figure 4:
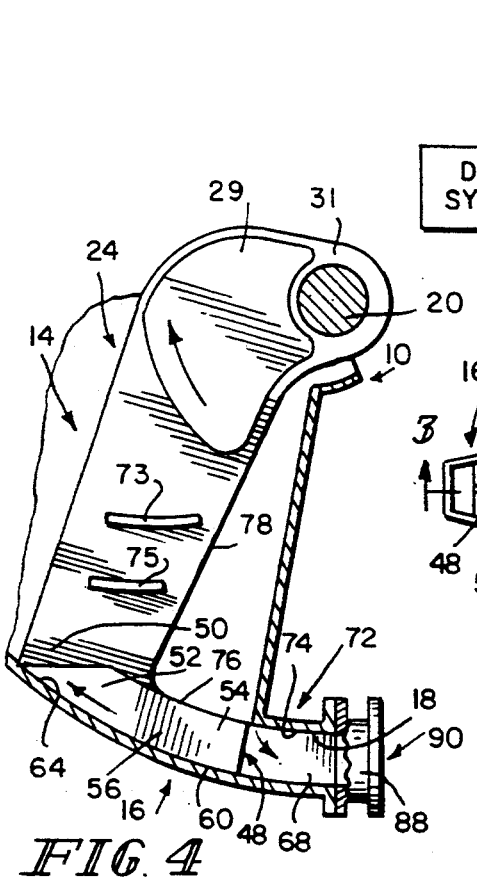
FIG. 4 is a view similar to FIG. 3 showing the ram and the swing arm during the backstroke of the ram and a valve just outside the discharge outlet.
Figure 5:
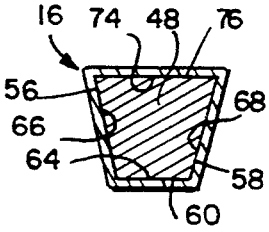
FIG. 5 is a sectional view taken along line 5—5 of FIG. 3 showing the trapezoidally shaped ram in the trapezoidally shaped material-receiving cavity of the trough.

A ram 48 is mounted on a lower end 50 of swing arm 24 and shaped to pass through the curved trough 16 as the swing arm 24 moves back and forth between its raised and lowered positions. The ram 48 includes a body 52 having a trapezoidal cross-sectional shape shown best in FIG. 5 and a nose 54 appended to a forward end of the body 52. The body includes first and second inclined side walls 56, 58 and a curved bottom surface 60. The nose 54 also has a trapezoidal shape matching the trapezoidal shape of the discharge outlet 18. The body 52 is an elongated curved member as shown in FIGS. 3 and 4. The swing arm 24 moves the ram 48 back and forth in curved trough 16 to cause waste material (not shown) that has fallen into the open trough 16 from the overlying hopper 12 in the space between the nose 54 of ram 48 and discharge outlet 18 to be discharged through the discharge outlet 18.

The open trough 16 is inclined and curved as shown best in FIG. 3. The inclined trough 16 is formed to include a curved material-receiving channel 62. This channel 62 includes a curved floor 64 and first and second inclined side walls 66, 68 on either side of the curved floor 64. The channel side walls 66, 68 extend along the curved floor 64 in spaced-apart relation to one another and converge toward the floor 64 to provide the channel 62 with a transverse trapezoidal shape substantially matching the transverse cross-sectional shape of ram 48. Waste material in interior region 14 of hopper 12 can fall under gravity into the curved, inclined, trapezoidally shaped material-receiving channel 62 through a top opening 70 formed in trough 16.

The trough 16 also includes a feed chamber 72 extending outwardly from the bottom of hopper 12 as shown best in FIG. 1. Feed chamber 72 is formed to include an inlet at its inner end and the discharge outlet 18 at its outer end. The curved material-receiving channel 62 is arranged to pass through the feed chamber 72. The feed chamber 72 also includes a curved ceiling 74 extending between the inlet and the discharge outlet 18. This curved ceiling 74 lies in uniformly spaced-apart relation to the curved floor 64. The body 52 of ram 48 also includes a curved top surface 76 that slides on the curved ceiling 74 of the feed chamber 72 during passage of the ram 48 through the feed chamber 72. The ram 48 is thus shaped to engage the inclined side walls 66, 68, curved floor 64, and curved ceiling 74 during passage of the ram 48 through the material-receiving channel 62. Enough clearance is provided to enable the ram to move back and forth through feed chamber 72 as required.

Suitable applications for the improved feeder 10 are container-filling systems and rotary kiln feed systems. One purpose of this invention is to provide a hopper and feeder that overcome the material handling limitations of conventional feeders. It is based on the use of a swing-arm ram 24, 28 that oscillates through almost a 90° arc, between the 9 o'clock and 6 o'clock positions, as illustrated in the drawings. At its radial extremity, the swing arm 24 is attached to the back end of the ram 48 so that the nose 54 of the ram 48 protrudes beyond the leading edge 78 of the arm, typically 10 to 20 inches (25.4 to 50.8 cm). As the swing arm 24 nears the end of the rotation toward the 6 o'clock position, the nose 54 of the ram 48 enters an enclosed feed chamber 72, which has a length that is about the same length as the nose portion of the ram 48.

Various hopper shapes may be used to enclose the swing arm 24 and provide suitable material holding capacity, but ideally it will be based on the following design. The bottom of the hopper 12 that encloses the swing arm 24 corresponds to the outer arc of the swing-arm ram 48 and consists of a trough 16 with the same trapezoidal cross section as the ram 48, with reasonable running clearances. The feed chamber 72 referred to above is an extension of this trough 16, with the top enclosed. The sides of the hopper 12 that are attached to the trough 16 are made up of two opposing quarter-sections 80, 82 of a 60° cone (see angles 84 in FIG. 2), the 6 o'clock to 9 o'clock quarters. Alternatively, the cone angle could range from about 45° to 75°.

The third side 86 of hopper 12 is a nearly vertical flat plate that closes off the open end of the two opposing cone quarter sections 80, 82. The pivot shaft 20 to which the swing arm 24 is attached is located at the center of the cone quarter sections 80, 82 and arranged to lie along the coaxially aligned central axes of the cone quarter sections 80, 82.

The use of two opposing quarter sections 80, 82 of a cone attached to opposite sides of the trough 16 defines a funnel shape that provides the maximum opportunity for material to flow toward the open mouth 70 of the trough 16, while at the same time providing the maximum contained volume without dead spaces where material might tend to accumulate. This is a key factor in ensuring good downward flow of material toward the trough 16 for all portions of the hopper 12.

An upper section of hopper 12 is shown best in FIGS. 1–3. Illustratively, hopper 12 also includes a first flat upper side wall section 91 above the first cone quarter section 80 and a second flat upper side wall section 92 above the second cone quarter section 82. A flat vertical front wall 93 interconnects the spread-apart front edges of side wall sections 91 and 92. Front wall 93 lies in spaced-apart parallel relation to pivot shaft 20. The lower end of front wall 93 is rounded as shown in FIGS. 1 and 3 to blend into and mate with the upper end of the rearwardly sloping third side 86 of the lower section of hopper 12.

The operation of feeder 10 is as follows, beginning at the end of a completed stroke with the swing arm 24 nearly vertical and the nose 54 of the ram 48 fully engaged in the feed chamber 72. As the swing arm 24 starts back from the 6 o'clock position, a partial vacuum created by the ram 48 exiting the feed chamber 72 pulls material into the feed chamber 72. A discharge pipe 88 or duct attached to the hopper 12 contains a valve 90 configured to prevent backflow of material into feed chamber 72 during the backstroke. Movement of the swing arm 24 and ram 48 during the backstroke and displacement of the hopper contents caused by this movement provide the necessary agitation to overcome material bridging problems. This may be enhanced by attaching one or more blades 73, 75 at right angles to the sides of the swing arm 24. These blades 73, 75 may also be used to provide some degree of mixing of the hopper contents during pivoting of swing arm 24.

Upon reaching the 9 o'clock position, the swing arm 24 reverses, to start the material pumping stroke. On the forward swing, with the agitation and mixing action continuing, material is pushed ahead of the ram nose 54 in the trough section of the hopper 12. Filling of the feed chamber 72 with material is completed by this action as the ram 48 enters the feed chamber 72. Then the ram 48 forces the material out the feed chamber 72 through the discharge outlet 18 and into the discharge pipe 88. This dispenses a slug of material into a container-filling system or other material-handling system where it can be transported to an incinerator, a cement kiln, or other destination.

Advantages of this invention include the following: the ability to handle stringy, sticky, heterogeneous shredded solid waste materials and sludges; the elimination of bridging problems in the hopper; the elimination of the material buildup behind the ram; and the combination of simultaneous mixing and feeding in a single hopper. Feeder 10 is able to deliver a series of batches of waste material to a container-filling system or other waste material-handling system and thus play an important role in solving the challenging problem of disposing waste sludges and solids effectively.

The trapezoidal shape of the trough 16 provides for efficient filling of the trough 16 with material during the ram backstroke and it encloses the ram 48 on three sides and minimizes the opportunity for material to be pushed aside on the forward stroke of ram 48. The feature of containment in the trough 16 means that material that has fallen into the trough 16 will be pushed forward by the ram 48, formed, and contained within the trough 16, as a charge of material that will be easily forced into the feed chamber 72 at the end of the stroke. The feed chamber 72 has a prescribed length and volume depending upon the application, which fixes the feeding volume per stroke. For maximum volumetric efficiency, the feed chamber 72 should be completely filled on each stroke. To a large extent this is achieved by ensuring that a plug of material equal or greater in length than that of the feed chamber 72 is moved forward ahead of the ram 48. Providing an enclosed trough 16 as an extension of the feed chamber 72, and one that will be efficiently filled by the natural flow of material in the hopper, achieves this objective.

A shutoff valve 90 at the discharge outlet 18 of the feed chamber 72 provides two added functions. First, by closing off the exit during the backstroke a partial vacuum is created in the feed chamber 72 as the ram 48 exits the chamber 72 (this vacuum promotes the flow of material into the feed chamber 72 during the backstroke, as an initial filling step). This is particularly important when handling shredded solid waste materials that do not flow easily. By providing some initial fill, a lesser quantity of material is required during the forward stroke of the ram. Second, the shutoff valve 90 can be used to help compact material in the feed chamber. For some applications it is desirable to compact the material in the feed chamber 72 before discharging. This is achieved by keeping the valve 90 closed during the forward stroke until the ram 48 enters the feed chamber 72. The degree of compaction can be varied by varying the force that drives the swing arm 24.

The nearly 90° arc of the swing arm ram 48, with the same cross-section shape as the trough 16, traveling in the close-fitting trough for the full length of travel, fulfills three functions: (a) it provides the maximum length of travel within the confines of the hopper shape, and thus the maximum opportunity for material to be picked up ahead of the ram 48 to form the charge (again, this is of particular importance when dealing with heterogeneous, non-flowable materials); (b) it provides a mixing function by ploughing through the material during the backstroke, displacing material that has fallen into the trough 16 during the forward stroke; and (c) it overcomes any bridging tendency of the material by breaking up arching bridges that may form over the trough 16, thus ensuring flowability even with materials classified as non-flowable.

The mixing action is enhanced by adding mixing blades 73, 75 to the sides of the swing arm 24. These blades can be easily changed so as to provide the optimum shape for each type of material.

Although the invention has been described and defined in detail with reference to certain preferred embodiments, variations and modifications exist within the scope and spirit of the invention as described and defined in the following claims.

We claim:

1. A feeder for discharging a load of material to a place outside the feeder, the feeder comprising hopper means for holding a supply of material, the hopper means being formed to include an interior region containing the supply of material and a discharge outlet, the hopper means further including an inclined trough located in a bottom portion of the interior region, the inclined trough being formed to include a curved material-receiving channel having a curved floor and communicating with the interior region of the hopper and the discharge outlet of the hopper, a ram movable in the curved material-receiving channel and on the curved floor between a raised position away from the discharge outlet and a lowered position adjacent to the discharge outlet, and means for moving the ram on the curved floor from its raised position to its lowered position to discharge a load of material lying in the curved material-receiving channel out of the hopper through the discharge outlet to a place outside the feeder, the moving means including a swing are positioned in the interior region and coupled to the ram and means for pivoting the swing arm in the interior region about a pivot axis to move the ram in the curved material-receiving channel and on the curved floor between the raised and lowered positions, the curved floor having a center of curvature and being curved and oriented to position the center of curvature on the pivot axis of the pivoting means.

2. The feeder of claim 1, wherein the ram includes a body having a curved bottom surface riding on the curved floor of the material-receiving channel and a nose appended to a forward end of the body and sized to pass through the discharge outlet during movement of the ram from its raised position to its lowered position.

3. The feeder of claim 1, further comprising valve means at the discharge outlet for preventing backflow of material already discharged from the material-receiving channel through the discharge outlet back into the material-receiving channel during movement of the ram from its lowered position to its raised position.

4. The feeder of claim 3, wherein the valve means includes a discharge pipe coupled to the hopper means at the discharge outlet and a shutoff valve in the discharge pipe.

5. The feeder of claim 1, further comprising a plurality of horizontally extending mixing blades appended to the swing arm and arranged to pass through and stir material contained in the interior region of the hopper means during pivoting movement of the swing arm.

6. The feeder of claim 5, wherein a first set of the horizontally extending mixing blades extend away from the swing arm in a first direction and a second set of horizontally extending mixing blades extend away from the swing arm in an opposite second direction.

7. The feeder of claim 1, wherein the trough has a trapezoidal shape and includes first and second inclined side walls extending along the curved floor of the material-receiving channel in spaced-apart relation to one another and converging toward the floor to define the trapezoidal shape.

8. The feeder of claim 7, wherein the ram includes a body having a trapezoidal cross-sectional shape and a nose appended to forward end of the body.

9. The feeder of claim 8, wherein the body includes one inclined side wall engaging the first inclined side wall of the trough, another inclined side wall engaging the second inclined side wall of the trough, and a curved bottom surface engaging the curved floor of the material-receiving channel.

10. The feeder of claim 2, wherein the hopper is formed to provide a trapezoidally shaped discharge outlet, the nose of the ram has a trapezoidal shape matching the trapezoidal shape of the discharge outlet, and the nose is sized to engage the first and second inclined side walls and the curved floor in close fitting relation during passage of the ram through the tranpezoidally shaped discharge outlet.

11. A feeder for discharging a load of material to a place outside the feeder, the feeder comprising hopper means for holding a supply of material, the hopper means being formed to include an interior region containing the supply of material and a discharge outlet, the hopper means further including an inclined trough located in a bottom portion of the interior region, the inclined trough being formed to include a curved material-receiving channel having a curved floor and communicating with the interior region of the hopper and the discharge outlet of the hopper, a ram movable in the curved material-receiving channel and on the curved floor between a raised position away from the discharge outlet and a lowered position adjacent to the discharge outlet, and means for moving the ram on the curved floor from its raised position to its lowered position to discharge a load of material lying in the curved material-receiving channel out of the hopper through the discharge outlet to a place outside the feeder, the through including first and second trough side walls extending along the curved floor of the material-receiving channel and lying in spaced-apart relation to one another, each trough side wall including a curved top edge lying in spaced-apart relation to the curved floor of the material-receiving channel, the hopper means further includes a first conical side wall section appended to the curved top edge of the first trough side wall and a second conical side wall section appended to the curved top edge of the second trough side wall, and the first and second conical side wall sections lying in spaced-apart cup-shaped relation to funnel material in the interior region into the curved material-receiving channel.

12. The feeder of claim 11, wherein the first and second trough side walls are inclined to converge from the curved top edges toward the curved floor of the material-receiving channel.

13. A feeder for discharging a load of material to a place outside the feeder, the feeder comprising hopper means for holding a supply of material, the hopper means being formed to include an interior region containing the supply of material and a discharge outlet, the hopper means further including an inclined trough located in a bottom portion of the interior region, the inclined trough being formed to include a curved material-receiving channel having a curved floor and communicating with the interior region of the hopper and the discharge outlet of the hopper.

a ram movable in the curved material-receiving channel and on the curved floor between a raised position away from the discharge outlet and a lowered position adjacent to the discharge outlet, and means for moving the ram on the curved floor from its raised position to its lowered position to discharge a load of material lying in the curved material-receiving channel out of the hopper through the discharge outlet to a place outside the feeder, the ram including a body having a curved bottom surface riding on the curved floor of the material-receiving channel and a nose appended to a forward end of the body and sized to pass through the discharge outlet during movement of the ram from its raised position to its lowered position, the hopper means further including a feed chamber formed to include an inlet at one end and the discharge outlet at the other end, the curved material-receiving channel being arranged to pass through the feed chamber, the feed chamber further including a curved ceiling extending between the interior region and the discharge outlet and lying in uniformly spaced-apart relation to the curved floor of the material-receiving channel, and the body of the ram including a curved top surface sliding on the curved ceiling of the feed chamber during passage of the ram through the feed chamber.

14. A feeder for discharging a load of material to a piece outside the feeder, the feeder comprising hopper means for holding a supply of material, the hopper means being formed to include an interior region containing the supply of material and a discharge outlet, the hopper means further including an inclined trough located in a bottom portion of the interior region, the inclined trough being formed to include a curved material-receiving channel having a curved floor and communicating with the interior region of the hopper and the discharge outlet of the hopper, a ram movable in the curved material-receiving channel and on the curved floor between a raised position away from the discharge outlet and a lowered position adjacent to the discharge outlet, and means for moving the ram on the curved floor from its raised position to its lowered position to discharge a load of material lying in the curved material-receiving channel out of the hopper through the discharge outlet to a place outside the feeder, the trough having a trapezoidal shape and including first and second inclined side walls extending along the curved floor of the material-receiving channel in spaced-apart relation to one another and converging toward the floor to define the trapezoidal shape, the hopper being formed to include an upper wall defining a top opening into the interior region, and the trough including an upper section forming a portion of the upper wall.

15. The feeder of claim 14, wherein the upper wall includes first and second side wall sections and a front wall section arranged to define a triangular-shaped border around the top opening and the rough includes an upper end located at a junction between the first and second side walls and a lower end located under the front wall section.

16. The feeder of claim 14, wherein the moving means includes a swing arm positioned in the interior region and coupled to the ram and means for pivoting the swing arm in the interior region to move the ram between its raised and lowered positions and the pivoting means includes a pivot shaft lying adjacent to the front wall section and passing through each of the first and second side wall sections.

17. A feeder for discharging a load of material to a place outside the feeder, the feeder comprising hopper means for holding a supply of material in an interior region, a trough appended to the hopper means, the trough being formed to include a top opening communicating with the interior region of the hopper means and a trapezoidal material-receiving channel underlying the top opening and having a trapezoidal cross-sectional shape, a trapezoidally shaped ram movable in the material-receiving channel, and means for moving the ram in the trapezoidal material-receiving channel to discharge a load of material lying in the trapezoidal material-receiving channel through a discharge outlet formed in the trough.

18. The feeder of claim 17, further comprising valve means at the discharge outlet for preventing backflow of material already discharged from the trapezoidal material-receiving channel through the discharge outlet back into the trapezoidal material-receiving channel during movement of the ram in the trapezoidal material-receiving channel away from the discharge outlet.

19. The feeder of claim 17, wherein the trough is curved to extend the trapezoidal material-receiving channel along an arc that has a length that is at least one quarter of a segment of a circle and the moving means includes a swing arm appended to the ram and means for swinging the swing arm through a 90° arc to move the ram through the trapezoidal material-receiving channel between a raised position away from the discharge outlet and a lowered position adjacent to the discharge outlet.

20. The feeder of claim 19, wherein the trough includes a curved floor underlying the top opening and first and second side walls extending along the floor in spaced-apart relation to one another to define the trapezoidal material-receiving channel therebetween an converging toward the floor to define the trapezoidal cross-sectional shape of the trapezoidal material-receiving channel.

21. The feeder of claim 17, wherein the trough includes first and second trough side walls extending along the top opening and lying in spaced-apart relation to one another to define the trapezoidal material-receiving channel therebetween, each trough side wall includes a curved top edge, the hopper means further includes a first conical side wall section appended to the top edge of the first trough side wall and a second conical side wall section appended to the top edge of the second trough side wall, and the first and second conical side wall sections lie in spaced-apart cup-shaped relation to funnel material in the interior region into the trapezoidal material-receiving channel through the top opening in the trough.

22. The feeder of claim 21, wherein each conical side wall section is a quarter section of a cone having a conical side wall and a central axis and a 60° included angle between the conical side wall and the central axis.

23. The feeder of claim 21, wherein the trough includes a curved floor and the first and second trough side walls are inclined to converge from the curved top edges toward the curved floor to define the trapezoidal cross-sectional shape of the trapezoidal material-receiving channel.

24. The feeder of claim 17, wherein the trough includes a floor and first and second side walls extending along the floor in spaced-apart relation to one another to define the trapezoidal material-receiving channel therebetween and converging toward the floor to define the trapezoidal cross-sectional shape of the trapezoidal material-receiving channel.

25. The feeder of claim 24, wherein the floor is curved and the ram is movable on the curved floor between a raised position away from the discharge outlet and a lowered position adjacent to the discharge outlet.

26. The feeder of claim 25, wherein the curved floor has a radius of curvature and the ram includes a curved bottom surface having a radius of curvature matching the radius of curvature of the curved floor.

* * * * *